US005732526A

United States Patent [19]

Farley

[11] Patent Number: 5,732,526

[45] Date of Patent: Mar. 31, 1998

[54] REPAIR PROCEDURE FOR DELAMINATED CONTAINER CEILING SHEET AND STRUCTURE PRODUCED THEREBY

[76] Inventor: Glenn Farley, 13 Currier Pl., Cheshire, Conn. 06410

[21] Appl. No.: 667,585

[22] Filed: Jun. 24, 1996

[51] Int. Cl.[6] ..... E04G 23/02

[52] U.S. Cl. ..... 52/741.3; 52/512; 52/514; 52/742.1

[58] Field of Search ..... 52/514, 506.06, 52/512, 741.3, 741.4, 742.1, 746.1

[56] References Cited

U.S. PATENT DOCUMENTS

| | | | |
|---|---|---|---|
| 1,507,652 | 9/1924 | Youngberg | 52/606.06 X |
| 3,432,979 | 3/1969 | Heimann | 52/741.04 X |
| 3,463,432 | 8/1969 | Ptak | 52/506.06 X |
| 4,263,763 | 4/1981 | Bouwens | 52/506.06 X |
| 5,177,922 | 1/1993 | Ovaert et al. | 52/512 X |
| 5,257,490 | 11/1993 | Endo et al. | 52/512 X |

FOREIGN PATENT DOCUMENTS

| | | | |
|---|---|---|---|
| 423352 | 4/1911 | France | 52/506.06 |
| 2175036 | 11/1986 | United Kingdom | 52/514 |

*Primary Examiner*—Wynn E. Wood
*Assistant Examiner*—Timothy B. Kang
*Attorney, Agent, or Firm*—Dallett Hoopes

[57] ABSTRACT

The process includes the steps of removing a circle of ceiling sheet and cylinder of insulation material to create a work space under a portion of one of the I-beam-like roof bows and maneuvering in the space a U-shaped clamp having inward ribs at the upper end of its legs to straddle and hook over the bottom flange of the bow. A threaded rod extending through a threaded bore in the bight of the clamp is tightened to fix the clamp to the bow. A bearing nut with a wide plate is then screwed onto the lower end of the rod so that the plate engages and supports the sheet. Insulation is then injected into the space.

3 Claims, 3 Drawing Sheets

FIG. 1
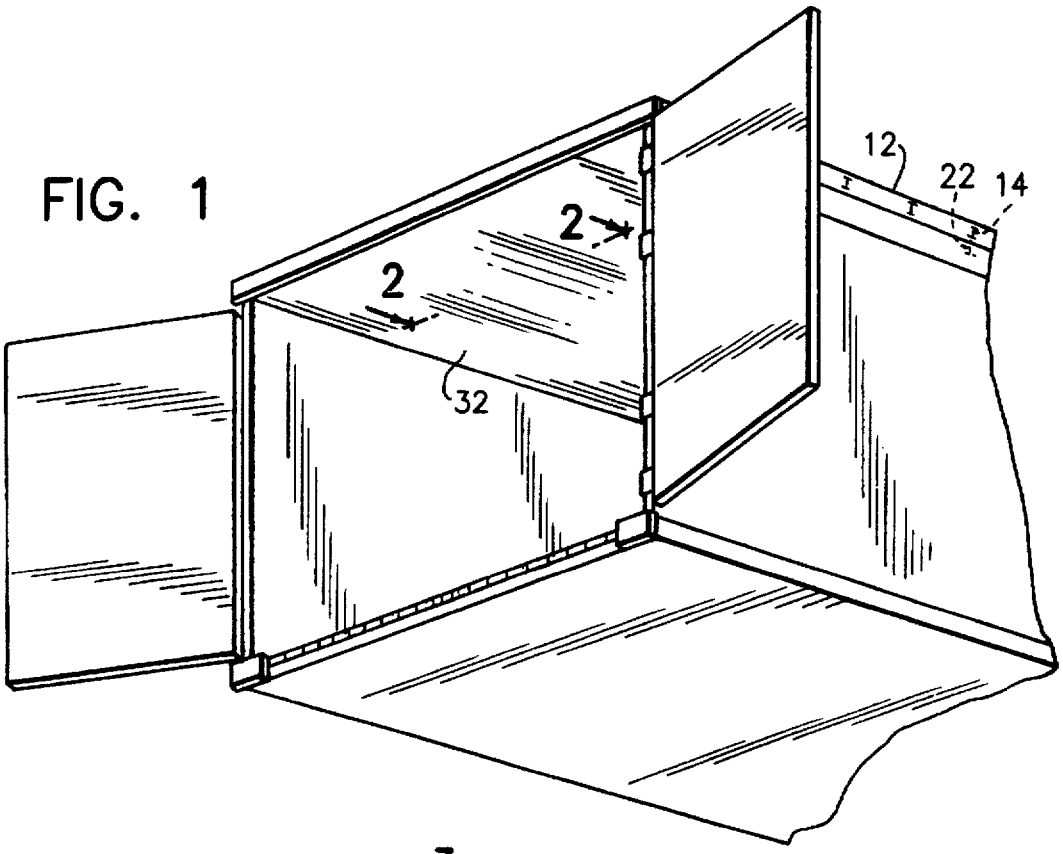
FIG. 2
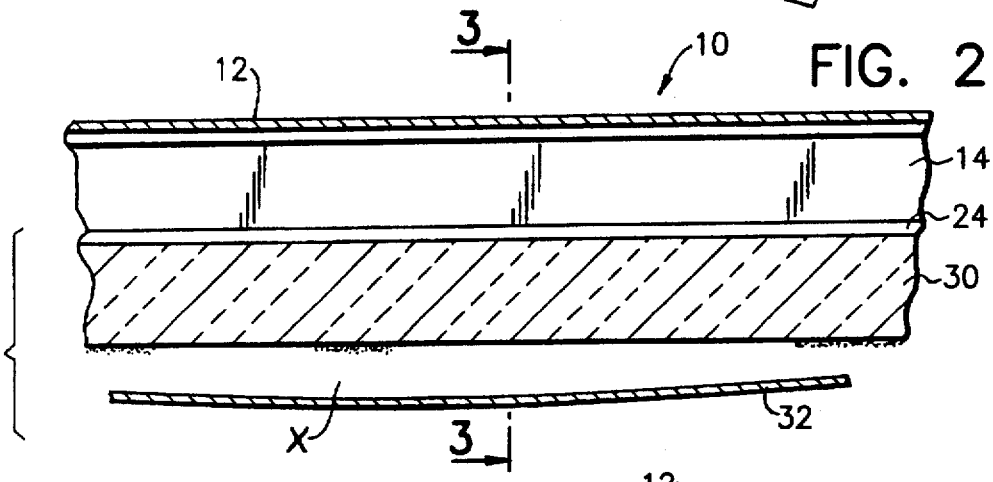
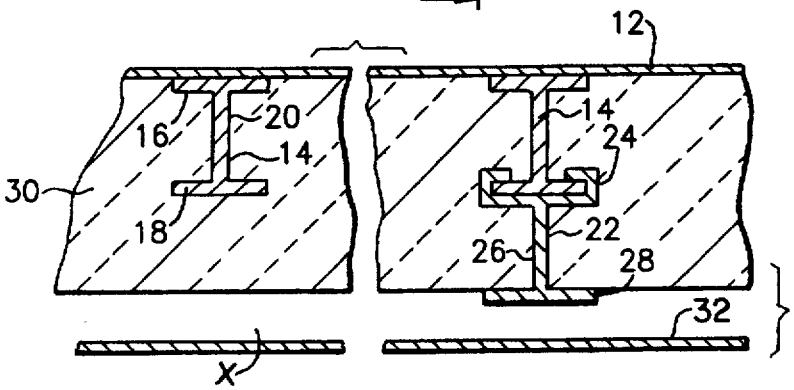
FIG. 3

REPAIR PROCEDURE FOR DELAMINATED CONTAINER CEILING SHEET AND STRUCTURE PRODUCED THEREBY

FIELD OF THE INVENTION

This invention relates to a procedure for repairing the delaminated protective metal ceiling sheet in a shipping container. The invention also relates to the structure produced in the repair procedure.

BACKGROUND OF THE INVENTION

In wide use today are metal intermodal containers. These containers are uniform and measure 40' long with an end opening which is about 8'×8' (FIG. 1). They are adapted to be packed at a point of origin, closed, and placed on a transportation means such as a rail flat car, or on a chasis to be pulled by truck, or a steamship deck, often in a stacked arrangement. At the destination, the containers are removed from the transportation means, opened and unpacked. The containers are produced in quantity and are made with inter-fitting end units by which an upper container can be secured against lateral movement with respect to a lower container.

Typically, refrigerated containers (those designed to carrier perishables, foods, etc., having temperature control units built in) have roof structures comprising a plurality of spaced horizontal bows, each bow being in the shape of an I-beam having spaced flanges and a connecting web. The bows are arranged with their flanges in horizontal alignment, and a roof cover sheet, such as a sheet of aluminum or stainless steel, is placed over the top of the bows and secured as by rivets to side top rails running the length of the container along the upper edges of the side walls. For obvious reasons, care is taken to avoid making any kind of hole in the top of the container.

Because it is important that an unreasonable temperature change within the container be avoided after desired temperature has been reached, insulation material is packed between adjacent bows. More specifically, the occasional bow, say every fourth bow, has secured to its lower flange a downward spacing stringer including a central web at the bottom of which is an outward flange. Insulation is disposed in the spaces between the bows and stringers down to the level of the bottom flange of the stringers. The insulation, which is high density foam, is held in place by being packed between the bows.

Finally, in the assembly of the container, an interior protective metal ceiling sheet, which may be of 0.050" aluminum, is secured against the bottom of the stringer flanges by an adhesive.

It has been the unfortunate experience of the owners of these containers that the adhesive has failed, causing a delaminating of the metal ceiling sheet down away from the stringers and the packed insulation (FIGS. 1, 2 and 3). Frequently this has caused the sheet to stretch and drop or sag down along the center line of the roof, for instance, the edges of the sheet still being supported between opposite side moldings. A minor sagging of the sheet can be tolerated, but will usually only grow worse. A sagging of three or four inches will disastrously limit the use of the container because the circulation of the air flow around the cargo becomes restricted, making it difficult to maintain a constant cooling temperature for the cargo.

Thus, the delamination of the protective metal ceiling sheet on the underside of the roof has greatly impaired the usefulness of containers and has demanded that a satisfactory procedure for repair be developed or that containers be scrapped.

It is for the repair of such containers that the present invention was developed.

SUMMARY OF THE INVENTION

The present invention is a procedure for repairing such delamination not affecting the integrity of the roof, and the structure produced by the procedure.

In the process the steps include removing a cylinder of material to create a cavity under a portion of one of the roof bows not having a spacing stringer. The cylinder includes a circular portion of the metal ceiling sheet and a cylinder of the high density foamed insulation to create an open cylindrical space and expose the bottom flange of the bow. Next, a U-shaped clamp is provided, the clamp having ribs at the upper end of its legs and a threaded vertical bore through its bight with a threaded epoxy resin vertical rod threadedly engaging the opening. The clamp is maneuvered so that its legs straddle the lower flange of the bow with the ribs engaged over the bow flange. The threaded rod is then tightened against the lower flange and a bearing nut having an outward plate formed thereon larger than the circular portion of the sheet. The bearing nut is then screwed onto the lower end of the rod so that the plate engages and supports the sheet. If desired or necessary, the plate may be formed with an opening to inject high density foamed insulation into the space. The plate should be riveted to the sheet to avoid its unscrewing.

From the standpoint of structure, the invention, once the procedure is effected, comprises a container roof having a plurality of I-beam-shaped roof bows arranged in a horizontal plane. Stringers extend down from selected bows and include a web and a lower flange. High density foamed insulation embeds the bows and stringers down to the level of the stringer flanges, and a sheet of protective metal butts against the bottom of the stringers. The sheet and the high density foamed insulation are formed with an open cylindrical cavity under a portion of one of the bows. A U-shaped clamp having inward ribs at the upper ends of its legs, straddles the bow in the space with the ribs hooked over the opposite edges of the bottom flange of the bow. The bight of the U-shaped clamp has a threaded vertical bore threadedly receiving an epoxy resin threaded rod, the upper end of which bears up against the bottom flange. A bearing nut having an outward plate larger than the cavity diameter is screwed onto the lower end of the threaded rod, the plate engaging and supporting the underside of the sheet.

BRIEF DESCRIPTION OF THE DRAWINGS

Further objects and features of the invention will be understood by those skilled in the art from a study of the following specification along with the drawings, all of which show a non-limiting embodiment of the invention. In the drawings:

FIG. 1 is a fragmentary perspective view looking upward of the end of a container with doors open. FIG. 1 shows the ceiling sheet delaminated;

FIG. 2 is a greatly enlarged sectional view taken on the line 2—2 of FIG. 1;

FIG. 3 is a fragmentary broken view, a sectional view taken on the line 3—3 of FIG. 2;

DESCRIPTION OF THE PREFERRED EMBODIMENT

Figure 4:
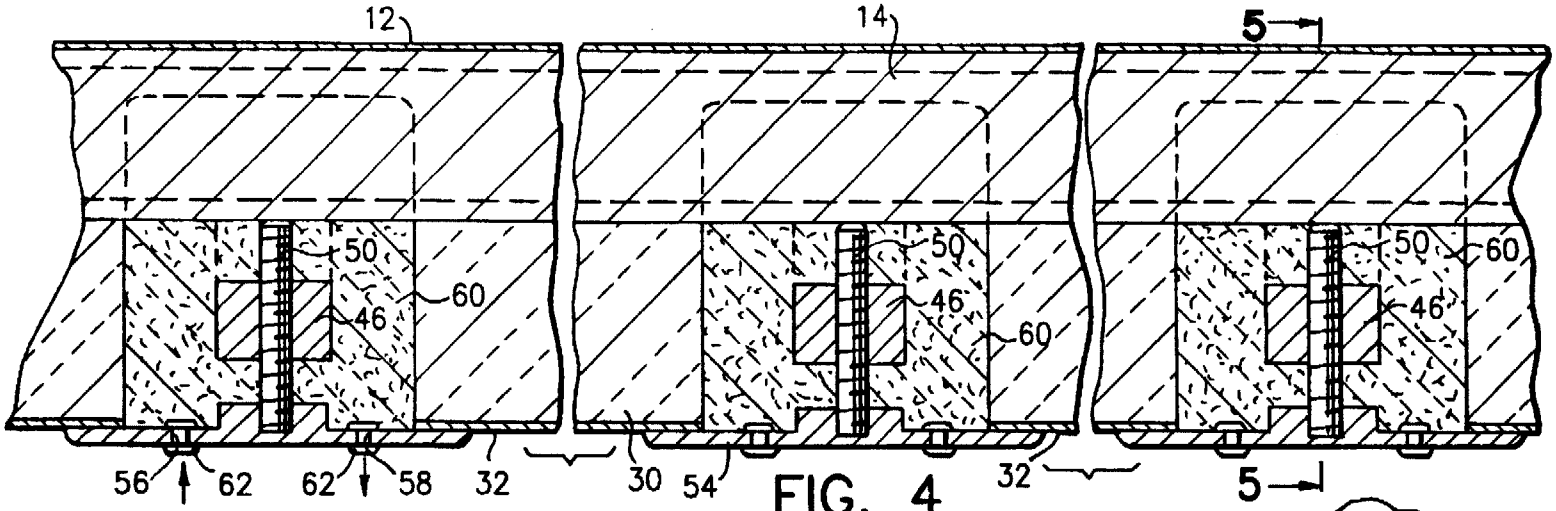
FIG. 4 is an enlarged broken sectional view after the repair procedure and showing a plurality of spaced repair assemblies as would be the case in actual practice.
Figure 7:
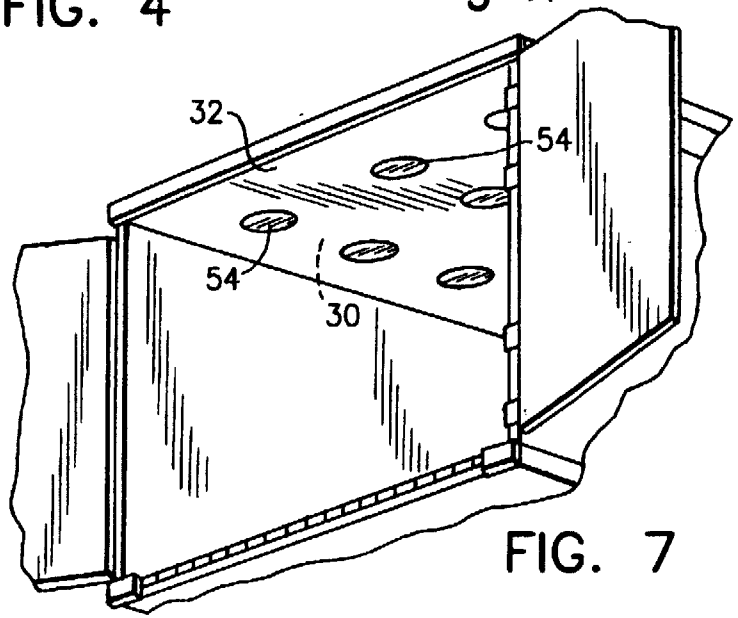
FIG. 7 is similar to FIG. 1 but showing the roof repaired.

A repair procedure of the invention is demonstrated in FIGS. 6A through 6F. The finished result is shown in FIGS. 4 and 7.

Prior to the practice of the invention, a container roof is generally designated 10 in FIG. 2. It comprises a cover sheet 12 resting on a plurality of spaced bows 14, the bows each having an I-beam cross-section including upper and lower flanges, 16 and 18 respectively and a connecting web 20. As is well known, the bows, shown in phantom in FIG. 1, are arranged in horizontal array so that their lower and upper flanges 16 and 18 are disposed respectively coplanar so that the cover sheet 12 lies flat.

From occasional bows—that is, from every fourth bow, for instance—a stringer 22 depends, each stringer comprising an upward C-shaped retaining structure 24 embracing the lower flange 18 of its bow, a central depending web 26 and a bottom flange 28, all the bottom flanges of the stringers being in the same horizontal plane.

The space surrounding the bows and stringers beneath the protective sheet 12 is embedded in high density foamed insulation 30. Normally this is supported from the underside by the protective metal ceiling sheet 32 which normally butts against the underside of the stringer flanges 28 and is secured thereto by high density foam and adhesive.

After delamination (FIGS. 1–3), as described above, the lower protective sheet 32 pulls away from the stringer flanges and sags downward, as at X, separated from the stringers by as much as three, four, or six inches along the center line of the container (FIG. 1).

DESCRIPTION OF THE REPAIR PROCEDURE

Figure 6A:
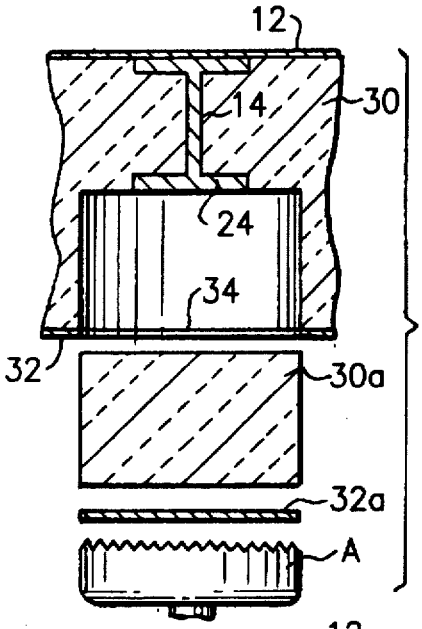
FIGS. 6A through 6F are reduced schematic fragmentary views illustrating the repair process of the invention.

As shown in FIG. 6A, the first step in the procedure is to support the protective metal sheet 32 up against the stringer flanges 28 and the bottom of the insulation 30. This can be done using a cargo jack, using as many as needed. The sheet 32 is then marked with parallel transverse lines spaced uniformly the length of the container to define the position of the bows. This can be done by suitable measuring equipment.

In the next step, a rotary hole saw having a blade A installed in the chuck of a power drill is used to core out a cylindrical section whose center is on one of the marked lines. This coring extends first through the metal sheet 32 to leave opening 34 and produce a circular metal piece 32*a*. Also, a cylinder 30*a* of high density foamed insulation up to the level of the lower flange 24 of the adjacent bow 14 is removed as in FIG. 6A.

Figure 6B:
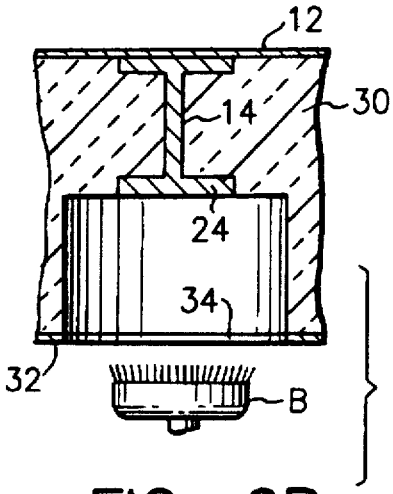
Figure 6C:
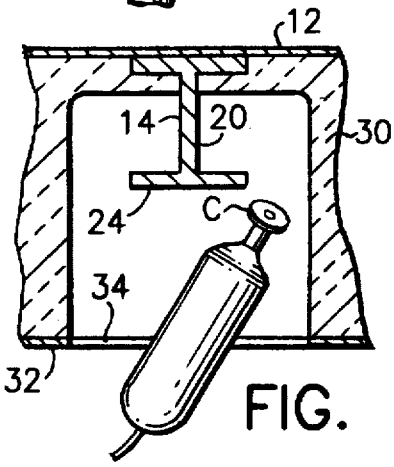
Figure 6D:
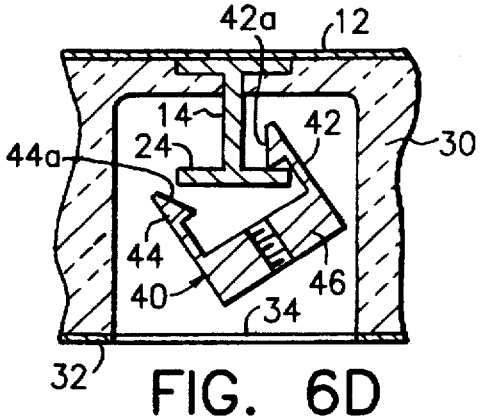
Figure 6E:
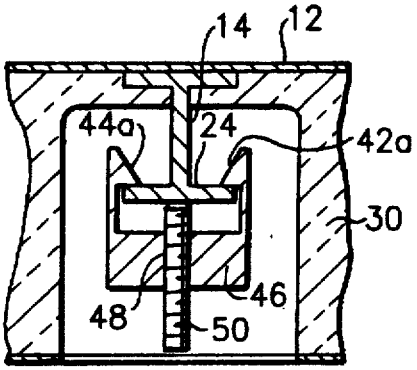
Figure 6F:
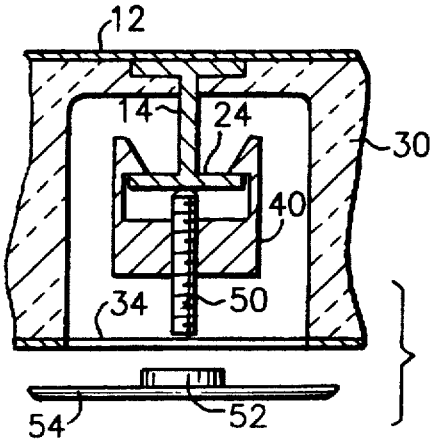

Next a rotary brush B which may be power-driven is raised and the cored-out space and the bottom of the flange 24 is cleaned off (FIG. 6B). This is followed (FIG. 6C) by an additional motorized tool having a cleaning disc C to remove the high density foamed insulation from a lower portion around the web 20 of the bow 14.

With the area on all sides of the lower flange 24 cleared out, there is now room to maneuver (FIG. 6D) a U-shaped clamp "RAC" 40. The legs 42 and 44 of the clamp 40 are made to straddle the lower flange 24 of the bow 14. The distal end of each leg is formed with an inward rib 42*a* and 44*a*. One leg 42 is then angled over the flange 24 and the clamp is moved upwardly and then pivoted so that the rib 44*a* clears the flange 24 as it is elevated.

The clamp is then swung to horizontal position (FIG. 6E) and brought down so that the ribs 42*a* and 44*a* engage over the upper side of the flange 24 to support the clamps. The bight 46 of the clamp is formed with a threaded bore 48 and a threaded rod 40 which is epoxy resin to help avoid conducting heat is made to engage in the threaded bore 48 and tightened so that it forcibly abuts the flange 24 intermediate its sides to hold the clamp securely onto the bow.

Next, (FIG. 6F) a nut 52 having a circular outward plate 54 of larger diameter than the opening 34 is threaded onto the threaded rod 50. It is brought up snugly (FIG. 4) so that it engages the sheet 30 about the margins of the opening 34 to support the sheet and return and maintain critical overall height of the ceiling.

The nut 52 and plate 54 is a unitary casting which may be formed with upward dimples on its under surface adapted to receive the spaced nibs of a spanner wrench (not shown) which may be used to tighten the nut 52 on the threaded rod 50.

In the next step of the process, spaced holes 56, 58 may be drilled in the plate 54 outside the nut (for instance, using the dimples as a start), and a high density foamed insulation 60 (FIG. 4) is injected through one of the holes 56, 58. This step is easily accomplished by injecting the foam from a hose or syringe through an inlet opening 56 until it comes out the outlet opening 58 at which point the space is substantially filled. Rings 62, as shown in FIG. 4, are used to ply the holes 56, 58.

Figure 5:
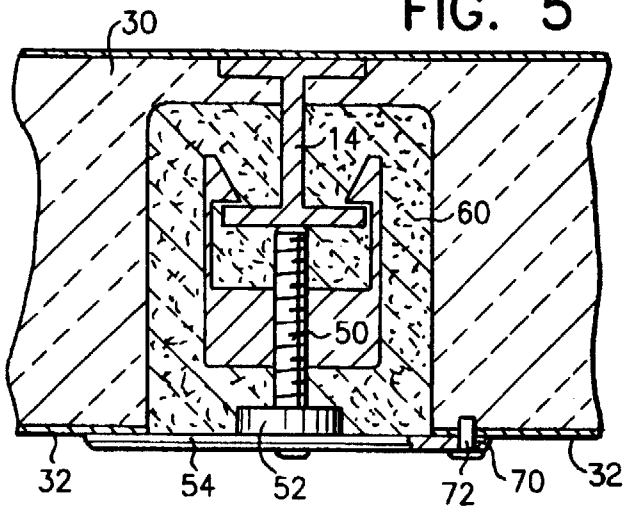
FIG. 5 is a sectional view taken on the line 5—5 of FIG. 4.

As best shown in FIG. 5, a hole 70 through the plate 54 is drilled adjacent the periphery of the plate 54 and into the protective ceiling sheet 32. A rivet 72 is extended through the hole and will block the rotation of the nut 52.

By virtue of the steps in the repair procedure described above, there is formed a structure as best shown in FIG. 5 whereby the plate 54 holds the sheet 30 up into position as if it were still laminated to the underside of the stringers. In this fashion the sheet 30 is held up sufficiently high so that it will not interfere with the circulation of the air flow around the contents of the container. The repair procedure of the invention, very importantly, does not penetrate the roof of the container and the integrity of the roof is not affected.

It will be understood that the repair structure such as shown in FIG. 5 is duplicated many times across and lengthwise of the protective ceiling sheet 32 so that looking up in the container (FIG. 7), one sees transverse lines of flat discs, the lines spaced uniformly along the length of the sheet excluding those areas in which there is a stringer.

It is believed that the present process and structure is an economical and reliable solution to the problem of delaminated protective sheets in containers.

Variations in the invention are possible. Thus, while the invention has been shown in only one embodiment, it is not so limited but is of a scope defined by the following claim language which may be broadened by an extension of the right to exclude others from making, using or selling the invention as is appropriate under the doctrine of equivalents.

What is claimed is:

1. A process for repairing a delaminated container roof, the roof comprising I-beam-shaped parallel uniformly spaced bows, each having upper and lower flanges and a connecting web, the bows arranged in a horizontal plane, occasional bows having depending stringers with flanges at their lower ends, the stringer flanges all being in the same horizontal plane, the bows and stringers being embedded in insulation material extending down to the level of the bottom of the stringer flanges, and a protective metal ceiling sheet normally bonded to the bottom of the stringers, but which has become delaminated, the process comprising:

1) removing a cylinder of material under a portion of one of the roof bows not having a stringer, the cylinder including a circular portion of the sheet and a cylinder of the insulation material to create a cylindrical space and expose the lower flange of the bow, 2) providing a U-shaped clamp having inward ribs at the upper ends of the legs of the clamp and a threaded vertical bore through the bight of the clamp with a threaded rod threadedly engaging the opening, 3) maneuvering the upper end of the clamp so that the legs of the clamp straddle the lower flange of the I-beam-shaped bow with the ribs engaging over the lower bow flange, 4) tightening the threaded rod so that the upper end of the threaded rod butts against said lower bow flange to solidly support the clamp on the flange, 5) providing a bearing nut having an outward plate formed thereon larger than the circular portion of the sheet, and 6) screwing the bearing nut onto the lower end of the rod so that the plate engages and supports the metal ceiling sheet.

2. A process as claimed in claim 1 including the further step of injecting a high-density foamed insulation into the cylindrical space.

3. A process as claimed in claim 1 wherein the process is commenced by supporting the ceiling sheet up against the stringers.

* * * * *